US007337840B2

(12) United States Patent
Penno

(10) Patent No.: US 7,337,840 B2
(45) Date of Patent: Mar. 4, 2008

(54) ONE TRIP LINER CONVEYED GRAVEL PACKING AND CEMENTING SYSTEM

(75) Inventor: Andrew D. Penno, Rio de Janeiro (BR)

(73) Assignee: Halliburton Energy Services, Inc., Houston, TX (US)

( * ) Notice: Subject to any disclaimer, the term of this patent is extended or adjusted under 35 U.S.C. 154(b) by 372 days.

(21) Appl. No.: 10/961,704

(22) Filed: Oct. 8, 2004

(65) Prior Publication Data

US 2006/0076133 A1 Apr. 13, 2006

(51) Int. Cl.
*E21B 43/04* (2006.01)
*E21B 33/13* (2006.01)

(52) U.S. Cl. ..... 166/278; 166/285

(58) Field of Classification Search ..... 166/51, 166/278, 285, 191
See application file for complete search history.

(56) References Cited

U.S. PATENT DOCUMENTS

| | | | | |
|---|---|---|---|---|
| 3,173,486 | A | 3/1965 | Smith | |
| 3,850,246 | A * | 11/1974 | Despujols | 166/278 |
| 4,105,069 | A | 8/1978 | Baker | |
| 4,295,524 | A | 10/1981 | Baker et al. | |
| 4,369,840 | A | 1/1983 | Szarka et al. | |
| 4,428,428 | A * | 1/1984 | Smyrl et al. | 166/278 |
| 4,436,151 | A | 3/1984 | Callihan et al. | |
| 5,361,830 | A | 11/1994 | Wicks, III et al. | |
| 5,595,246 | A | 1/1997 | Voll et al. | 166/278 |
| 5,597,040 | A * | 1/1997 | Stout et al. | 166/51 |
| 5,598,890 | A | 2/1997 | Richard et al. | 166/276 |
| 5,746,274 | A | 5/1998 | Voll et al. | |
| 6,464,008 | B1 | 10/2002 | Roddy et al. | 166/285 |
| 6,729,393 | B2 | 5/2004 | Vincent et al. | 166/177.4 |
| 6,782,948 | B2 * | 8/2004 | Echols et al. | 166/278 |
| 7,017,664 | B2 * | 3/2006 | Walker et al. | 166/278 |
| 7,096,946 | B2 * | 8/2006 | Jasser et al. | 166/278 |
| 2002/0096328 | A1 * | 7/2002 | Echols et al. | 166/278 |
| 2003/0085037 | A1 | 5/2003 | Roane et al. | |
| 2007/0051507 | A1 * | 3/2007 | Ross et al. | 166/51 |

OTHER PUBLICATIONS

"International Search Report and Written Opinion," PCT/US2005/035640, Jul. 4, 2006, 20 pgs.
Invitation to Pay Additional Fees, PCT/US2005/035640, Jan. 23, 2006, 7 pgs.

* cited by examiner

*Primary Examiner*—David Bagnell
*Assistant Examiner*—Daniel P. Stephenson
(74) *Attorney, Agent, or Firm*—Michael W. Piper

(57) ABSTRACT

A well completion assembly including apparatus for gravel packing and cementing in a single trip. An outer assembly comprises: a liner and screen; a valved gravel packing port; upper and lower valved cementing ports; and seal bores positioned below and above the gravel packing port and above and below the lower cementing port. An inner assembly includes: a crossover having an outer seal body and shifters to allow opening and closing of valves in the gravel packing and cementing ports. In one position, the crossover seal body mates with seal bores below and above the gravel packing port to allow flow of gravel packing slurry through the gravel packing port. In a second position, the crossover seal body mates with seal bores below and above the lower cementing port to allow flow of cement through the lower cementing port.

33 Claims, 6 Drawing Sheets

ONE TRIP LINER CONVEYED GRAVEL PACKING AND CEMENTING SYSTEM

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to completion of hydrocarbon producing wells and more particularly to a system and method for performing a gravel packing operation and a cementing operation with a single assembly run into a well in a single trip.

BACKGROUND OF THE INVENTION

Oil and gas wells are often completed with an open hole in unconsolidated producing formations containing fines and sand which flow with fluids produced from the formations. The sand in the produced fluids can abrade and otherwise damage tubing, pumps, etc. and must be removed from the produced fluids. Filters, e.g. sand screens, are commonly installed in well bores and gravel packed to filter out the fines and sand in the produced fluids.

The portion of the well above the producing formation is usually lined with a steel casing. The annulus between the casing and the well bore is normally filled with cement. When a screen is placed in the producing zone, a length of blank pipe, sometimes referred to as a liner, may be connected to the top of the screen assembly and extend upward into the cased portion of the well to provide a flow path for produced fluids from the screen to the cased portion of the well. At least a portion of the annulus between the blank pipe and open hole below the casing is normally filled with cement to hold the blank pipe and screen assembly in place and block annular flow of fluids around the blank pipe.

Thus, a well completion in an open hole zone usually requires both a gravel packing operation and a cementing operation. Both of these completion operations are well known. However, these operations have typically been performed using multiple sets of equipment run into the well at different times. For example, a length of blank pipe or liner may be placed in the well and a cementing assembly may be run into the well to perform cementing of the blank pipe or liner. Then, the cementing assembly is typically removed from the well. Then, a screen may be placed in the well and a gravel packing assembly may be run into the well for gravel packing the screen. Thus, multiple trips into the well have typically been required to place the blank pipe and the screen and to gravel pack the screen and cement the blank pipe. Each trip into the well to position equipment or perform an operation requires additional time and expense.

SUMMARY OF THE INVENTION

The present invention provides an assembly which may be used to perform both a gravel packing operation and a cementing operation in a single trip.

In one embodiment, the apparatus includes an outer assembly comprising a length of blank pipe and a screen. The outer assembly includes a valved gravel packing port for circulating gravel packing slurry into the annulus around the screen and includes a valved cementing port for flowing cement into the annulus around the blank pipe. The outer assembly also includes inner sealing surfaces positioned below and above the gravel packing port and above and below the cementing port.

In one embodiment, the apparatus includes an inner assembly carried within the outer assembly. The inner assembly includes a port and an outer sealing surface sized and positioned to mate with the outer assembly sealing surfaces. The inner assembly also includes shifters to allow opening and/or closing of valves in the gravel packing and cementing ports. In a first inner assembly position, the outer sealing surface mates with the outer assembly inner sealing surfaces below and above the gravel packing port to allow flow of gravel packing slurry through the gravel packing port. In a second inner assembly position, the outer sealing surface mates with outer assembly sealing surfaces below and above the cementing port to allow flow of cement through the cementing port.

In one embodiment, the inner assembly may be positioned to place the inner assembly port above the outer assembly sealing surface above the gravel packing port to allow reverse circulation to clean excess gravel packing slurry from the well. Likewise, the inner assembly may also be positioned to place the inner assembly port above the outer assembly sealing surface above the cementing port to allow circulation to remove excess cement from the well.

In one embodiment, the inner assembly is removed from the well after gravel packing and cementing and removal of the inner assembly closes the valves in the gravel packing port and the cementing ports.

In one embodiment, the inner assembly includes a wash pipe extending into the screen for facilitating gravel packing. In one embodiment where the inner assembly includes a wash pipe, the outer assembly includes a fluid loss control device. Upon removal of the inner assembly from the well, the fluid loss control device is closed.

DETAILED DESCRIPTION OF THE PREFERRED EMBODIMENTS

Figure 1A:
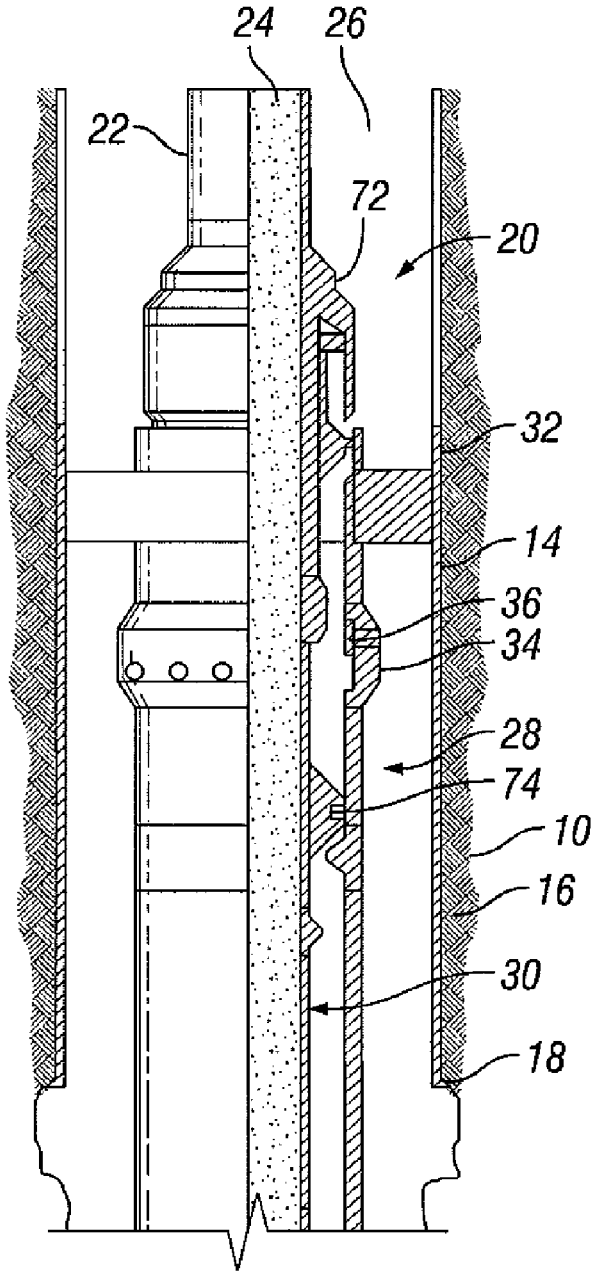
FIGS. 1*a* through 1*d*, illustrate a complete assembly according to an embodiment, as positioned in a well in preparation for gravel packing and cementing.
Figure 1B:
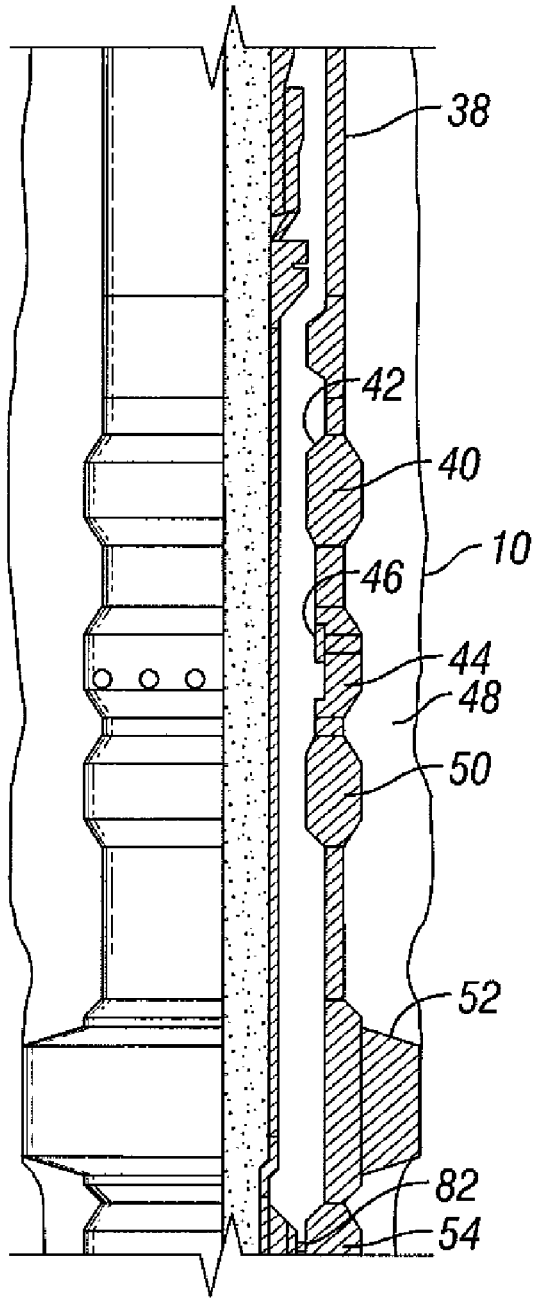
Figure 1C:
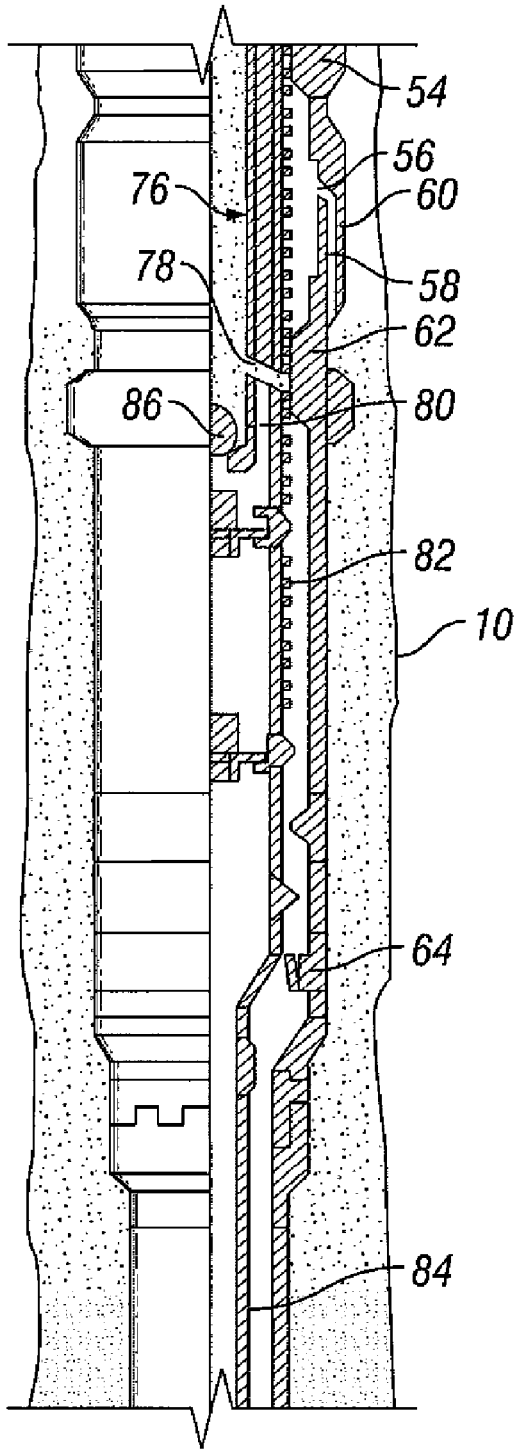
Figure 1D:
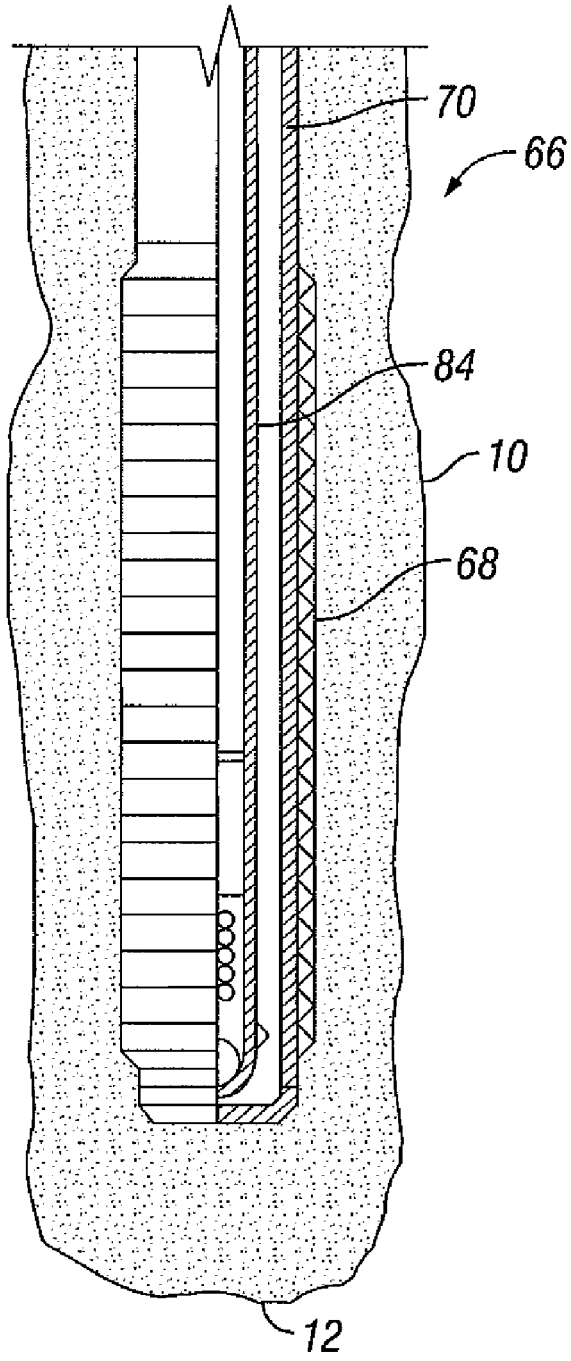

Various elements of the embodiments are described with reference to their normal positions when used in a borehole. For example, a screen may be described as being below or downhole from a crossover. For vertical wells, the screen will actually be located below the crossover. For horizontal wells, the screen will be horizontally displaced from the crossover, but will be farther from the surface location of the well as measured through the well. Downhole or below refers to a position in a well farther from the surface location in the well.

An annulus, as used in the embodiments, is generally a space between two generally cylindrical elements formed when a first generally cylindrical element is positioned inside a second generally cylindrical element. For example, a tubing is a cylindrical element which may be positioned in a wellbore, the wall of which is generally cylindrical forming an annulus between the tubing and the wellbore. While drawings of such arrangements typically show the inner element centrally positioned in the second, it should be understood that inner element may be offset and may actually contact a surface of the outer element at some radial location, e.g. on the lower side of a horizontal well. The width of an annulus is therefore typically not the same in all radial directions.

Cementing operations in a well and equipment used for such operations are generally well known in the oil well completion field. In general, the equipment provides a flow path through which liquid cement may be flowed from a work string into an annulus between a casing, liner, or other oilfield tubular element and a well. Since the well is normally filled with a fluid, e.g. drilling fluid, completion fluid, etc., the equipment also includes a return flow path for fluid displaced by cement during the cementing operation. A packer may be used between the work string and the casing, liner, etc. to prevent cement from entering the annulus between the work string and the casing, liner, etc.

Gravel packing operations in a well and equipment used for such operations is also generally well known in the oil well completion field. A complete gravel packing assembly may be considered to include a screen or other filter element and length of blank pipe extending from the screen, both of which are to be installed in a well, as well as equipment for placing a gravel pack around the screen in the well. The gravel packing equipment typically includes a work string having a packer and cross over assembly and a wash pipe extending below the cross over to the bottom of the screen. When properly positioned for a gravel packing operation, the packer seals the annulus between the work string and the well above the screen. A gravel packing slurry, i.e. liquid plus a particulate material, is then flowed down the work string to the crossover which directs the slurry into the annulus below the packer. The slurry flows to the screen which filters out the particulate to form a gravel pack around the screen. The fluid flows through the screen into the wash pipe back up to the crossover which directs the return flow into the annulus above the packer.

FIGS. 1*a* through 1*d* illustrate an embodiment of the present invention positioned in a well bore 10 extending from a surface location, not shown, to a bottom hole location 12. A casing 14 has been placed in an upper portion of the well 10 and the annulus between the casing 14 and well 10 has been filled with cement 16. Casing 14 may be nominal nine and five/eighth inch steel casing. Below the bottom of the casing 14 or casing shoe 18, the well remains in an open hole, i.e. uncased, condition. In many cases, the casing 14 is placed in an upper portion of well 10 and the open hole portion of the well 10 includes slanted, curved or otherwise deviated portions so that at the bottom hole location 12, the well is horizontal or near horizontal. The present invention is suitable for use in wells which are vertical to the bottom hole location 12 or which are slanted or deviated or horizontal over portions of their length.

An assembly 20 according to the present invention is shown positioned in the well 10 extending from the casing 14 down to the bottom hole location 12. The assembly 20 has been lowered into position on a work string 22 extending from the surface location of the well 10. A work string for purposes of the present invention may be any known pipe have the necessary strength and size to be lowered into and removed from a well 10 to position equipment in the well, flow materials into or from the well for various known operations, etc. A work string 22 may comprise any suitable oilfield tubular element including drill pipe, production tubing, etc. The work string 22 provides a first flow path 24 inside the work string 22 and a second flow path 26 in the annulus between the work string 22 and the casing 14. Fluids may be circulated from the surface down path 24 and back up annulus 26 or reverse circulated down annulus 26 and back up the path 24.

The assembly 20 includes an outer assembly 28 and an inner assembly 30. Inner assembly 30 is connected to the lower end of work string 22 throughout its use in the present invention so that it is run into the well 10 on the work string 22 and removed from the well 10 with the work string 22. The inner assembly may therefore be considered part of the work string 22. The outer assembly 28 is mechanically coupled to the inner assembly when the inner assembly 30 is run into the well 10, but, as explained below, is thereafter mechanically coupled to the casing 14 and disconnected from the inner assembly 30, allowing the inner assembly 30 to be repositioned relative to the outer assembly 28 by movements of the work string 22 from the surface location of the well 10.

The outer assembly includes a packer 32, which is shown inflated into sealing contact with the casing 14. Packer 32 may be a combination packer hanger to resist axial movement of the outer assembly 28 in the well 10, or may be only a hanger. In the preferred embodiment, the packer 32 provides a fluid tight seal between outer assembly 28 and the casing 14 as well as mechanically coupling the outer assembly 28 to the casing 14. Below the packer 32 is located an upper cementing port 34 including a sleeve valve 36 allowing the port 34 to be selectively opened or closed. In the run in position, the valve 36 is closed. Below port 34 is located a length of blank pipe 38. Blank pipe 38 is a conventional oil field tubular element, for example steel pipe and may be referred to as a liner because a portion of it may be positioned within the casing 14. In this embodiment, pipe 38 may have a nominal diameter of seven inches and a weight of twenty-three pounds per foot. The length of pipe 38 may be selected based on the distance from the casing shoe 18 to the producing formation or the required position of screens. The pipe 38 will typically pass through curved or deviated portions of the well 10 and may be of considerable length. The various other elements comprising the outer assembly 28 are connected together by various other sections of pipe 38 and/or collars, etc. In some applications, for example in a shallow well, it may be desirable for the pipe 38 to extend a considerable distance up the well 10 and possibly to the surface location and pipe 38 may replace the casing 14.

Below pipe 38 is located a seal bore 40 having an inner sealing surface 42. In this embodiment, the seal bore 40 may comprise a thick wall coupling or length of pipe having a polished inner seal bore surface 42 having a precise inner diameter, e.g. five inches, which is less than the minimum inner diameter of the pipe 38. Alternatively, the seal bore 40, and other seal bores used in the present invention, may be a coupling or length of pipe having an inner sealing surface 42 formed of an elastomeric material, e.g. one or more O-rings. As described in more detail below, the inner assembly 30 may carry an outer seal body to seal with the sealing surface 42. If the sealing surface 42 is a polished metal surface, the inner assembly may carry a matching elastomeric seal body. If the sealing surface 42 comprises an elastomeric element, then, the inner assembly may carry a matching polished metal seal body.

Below seal bore 40 is located a lower cementing port 44 including a sleeve valve 46 allowing the port 44 to be selectively opened or closed. In the run in position, the valve 46 is closed. The lower cementing port 44 also includes a spring biased one way valve, i.e. check valve, which allows fluids to flow out of the port 44 into the annulus 48, but blocks flow of fluids from the annulus 48 into the port 44. Other forms of flow direction biased one-way valves may be used if desired. Such a valve may be omitted if desired and may provide no benefit in some situations, for example if the entire interval to be cemented is horizontal. A second seal bore 50 is located below the port 44.

An external casing packer 52 is located below the second seal bore 50. Below the packer 52 is located a third seal bore 54. Below seal bore 54 is located a valved gravel packing port 56. The port 56 includes a sleeve valve 58 which is preferably in its open position when the assembly 20 is run in the well. The port 56 preferably includes an outer shroud 60 which directs fluids flowing out of port 56 down hole to avoid erosion of the wall of borehole 10. A fourth seal bore 62 is positioned below the port 56. Below the seal bore 62 is located a flapper valve 64. While a flapper valve 64 is used in this embodiment, other fluid loss control devices, e.g. a ball valve, may be used if desired.

A screen assembly 66 is located below the flapper valve 64. The screen assembly includes a screen 68 which may be any conventional or premium screen. Other forms of filters, such as slotted pipe or perforated pipe, may be used in place of screen 68 if desired. Above screen 68, a length of blank pipe 70 connects the screen 68 to the upper portions of the outer assembly 28. The pipe 70 may be of smaller diameter than the pipe 38, as illustrated. In some embodiments, the pipe 70 and base pipe used in the screen 68 may be of the same diameter as the blank pipe 38.

The inner assembly 30 includes a packer setting tool 72 at its upper end connected to work string 22. The tool 72 is used to set the packer 32 and to release the outer assembly 28 from the work string 22 once the packer 32 is set. The inner assembly includes shifters, e.g. 74, for opening and closing the sleeve valves 36, 46 and 58 as the inner assembly 30 is moved down and up in the well 10. The inner assembly 30 includes a crossover assembly shown generally at 76. The crossover 76 includes a port 78 in fluid communication with the flow path 24 through work string 22. It also includes a flow path 80 in fluid communication with the flow path 26 above packer 32.

On a cylindrical outer surface of crossover 76 is carried a seal unit or seal body 82 extending above and below the port 78. The seal unit 82 may be formed as a separate metal sleeve having a plurality of elastomeric rings on its outer surface. The outer diameter of the elastomeric rings may be slightly greater, e.g. 0.010 to 0.025 inch greater, than the inner diameter of the seal bores 40, 50, 54 and 62. In this embodiment, the seal bores 40, 50, 54 and 62 have polished metal inner surfaces, e.g. 42, with which such elastomeric rings may form fluid tight seals. In an alternative discussed above, the inner surfaces of seal bores 40, 50, 54 and 62 are formed by elastomeric elements such as O-rings. In this alternative, the seal body 82 may comprise only a metal sleeve having a polished outer surface having an outer diameter somewhat larger than the inner diameter of the elastomeric elements forming the inner sealing surfaces, e.g. 42, of the seal bores 40, 50, 54 and 62. In either case, the seal body 82 may form fluid tight seals with the seal bores 40, 50, 54 and 62 at any point along the length of the seal body 82. The seal body 82 has sufficient length above and below the port 78 to form seals with seal bores 40 and 50 at the same time and with seal bores 54 and 62 at the same time.

The lowermost portion of the inner assembly 30 comprises a wash pipe 84 which extends through flapper 64 and into the screen 68.

In FIGS. 1*a*-1*d*, the assembly 20 is shown in its run in position in well 10 and with the packer 32 set. The packer 32 was set by dropping a ball 86 down the work string 22. Before the ball 84 is dropped, the assembly 20 allows full fluid circulation in the well as the work string 22 and assembly 20 are run into the well. The packer setting tool 72 and pressure in the flow path 24 may be used to set the packer 32. After the packer 32 has been set, the well may be pressure tested by increasing pressure in the annulus 26.

In the run in position shown in FIG. 1, the cross over port 78 is located at the lowermost seal bore 62 below the gravel packing port 56. The seal body 82 contacts the seal bore 62 both above and below port 78, blocking all flow into or out of the port 78. Once the ball 86 is in place, the flow path 24 is isolated from the annulus 48 and annulus 26. After pressure testing the packer 32, the pressure in the annulus 26 may be increased to set packer 52, as illustrated in FIGS. 2-6.

Figure 2:
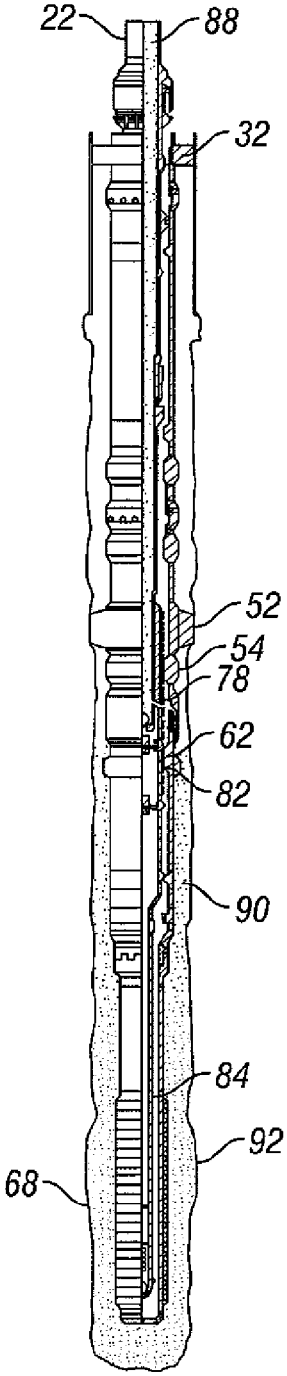
FIG. 2 illustrates the embodiment of FIG. 1, with the inner assembly in a gravel packing position.

The use of the apparatus of FIGS. 1*a*-1*d* will be described with reference to FIGS. 2-6. After the packers 32 and 52 have been set, as shown in FIG. 2, the inner string 30 may be repositioned for gravel packing the screen 68. By lifting the work string 22, the cross over port 78 may be positioned in fluid communication with the gravel packing port 56. This is achieved by positioning seal body 82 to contact the seal bores 54 and 62 above and below crossover port 78 respectively. A gravel packing slurry 88 may then be flowed from the surface down work string 22 and through port 78 and port 56 into the annulus 90. As in typical gravel packing, the liquid portion of the slurry flows through screen 68 and the particulate portion, or sand, packs the annulus 90 to form a gravel pack 92 around the screen 68. The liquid portion flows up the wash pipe 84, through crossover path 80 and through the annulus 26 back to the surface location of well 10.

In the FIG. 2 configuration, the present invention may be used to perform treatments other than or in addition to gravel packing. In some cases it may not be desired to gravel pack the screen 68 or other filter element. But it may be desirable to perform another treatment such as acidizing which requires flowing a fluid down the work string 22 and into the formation surrounding the screen 68. In the FIG. 2 configuration, any treating fluid may be flowed down the work string 22 and pumped into the annulus around screen 22. By blocking return flow through the annulus 26, pressure may be applied to force the fluid into the formation surrounding the screen 68. The present invention provides a convenient system for selectively gravel packing and/or otherwise treating the production zone surrounding the screen 68.

Figure 3:
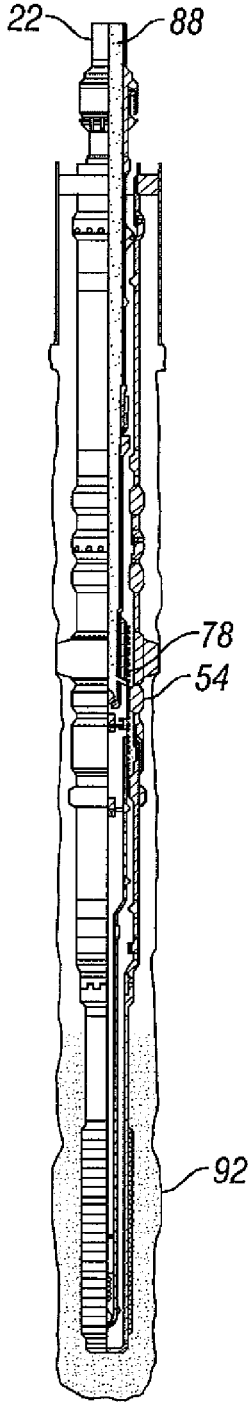
FIG. 3 illustrates the embodiment of FIG. 1, with the inner assembly in a reverse circulation position after gravel packing.

In FIG. 3, the work string 22 has again been lifted to move the cross over port 78 above the seal bore 54 while leaving the seal body 82 in sealing contact with the seal bore 54 below port 78. In this position, fluid may be reverse circulated down the annulus 26, into crossover port 78 and up the work string 22 to remove any remaining gravel packing slurry or treating fluid from the annulus 26 and work string 22.

Figure 4:
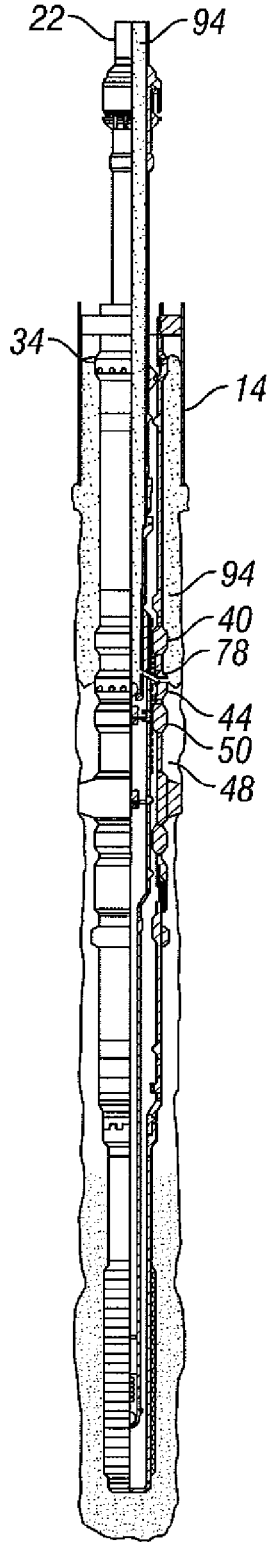
FIG. 4 illustrates the embodiment of FIG. 1, with the inner assembly in a cementing position.

In FIG. 4, the work string 22 has been moved into position for cementing the pipe 38 above the packer 52. The work string 22 has been first lifted to position sleeve shifters above the sleeve valves 36 and 46. During this lifting operation, another shifter preferably moves the sleeve 58 to close the gravel packing port 56. The work string 22 is then lowered to the position shown in FIG. 4. As it is lowered, shifters open the sleeve valves 36 and 46 in the upper and lower cementing ports 34 and 44. In this cementing position, the crossover port 78 is in fluid communication with the lower cementing port 44. The seal body 82 makes sealing contact with the seal bores 40 and 50, above and below the crossover port 78 respectively. In this position, cement 94 may be flowed down the work string 22, through crossover port 78 and lower cementing port 44 into the annulus 48. The cement 94 will then flow up the annulus 48 towards the upper cementing port. In this embodiment, the lower cementing port 44 includes a spring biased check valve. The spring bias may be adjusted to set a minimum pressure at which cement can be pumped through the valve and to provide positive closing of the check valve when pumping has stopped. It may be desirable to pump only enough cement to fill the annulus 48 up to about the location of the casing shoe 18, which is below the port 34. If excess cement is pumped, the excess may flow into the casing 14, through port 34 and back up the annulus 26. In some applications, e.g. shallow wells mentioned above, the blank pipe may extend a considerable distance up the well 10 and may replace casing 14. In such applications, the cementing operation may extend over the length of the pipe 38 and possibly to the surface location of the well and the upper cementing port 34 and packer 32 may be omitted After pumping of cement 94 is stopped, the work string 22 is again lifted a short distance to the position shown in FIG. 5. In this position, the cross over port 78 is positioned above the seal bore 40 and the seal body 82 below port 78 forms a seal with seal bore 40. Clean fluid may then be circulated down work string 22, through the port 78 and back up the annulus 26 to clean out any excess cement. If desired, the circulation may be reversed. The lower cementing port 44 includes a spring loaded check valve which closes when the pumping of cement stops. The check valve prevents flow of cement back into the lower cementing port 44 while the work string 22 is being cleaned.

In this embodiment, the cementing operation is performed after the gravel packing operation. This is believed to provide an advantage in the event that the packer 52 should fail to fully deploy and seal the annulus 90. Once the gravel pack 92 is in place, it may block the flow of cement to the annulus 90 around screen 68 even of packer 52 fails. However, if desired the apparatus of the present invention may be employed to selectively cement first and then gravel pack. In either case, only one trip into the well is required. In completions with multiple screens as discussed below, it may be desirable to cement around blank pipe sections between screens. In that situation, the cementing and gravel packing or other treatments may be performed alternately, i.e. gravel packing, followed by cementing, followed by gravel packing, etc.

Figure 5:
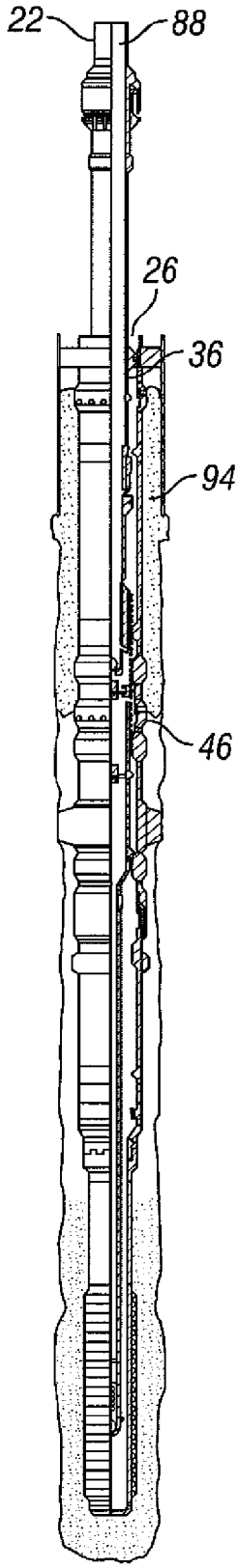
FIG. 5 illustrates the embodiment of FIG. 1, with the inner assembly in a circulation position after cementing.
Figure 6:
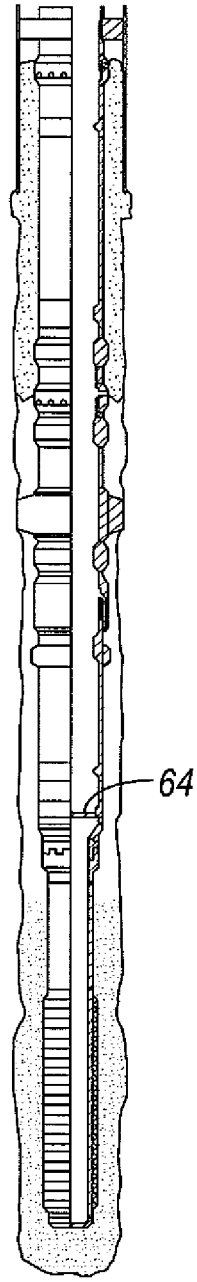
FIG. 6 illustrates the embodiment of FIG. 1, with the inner assembly removed.

After the cement has been placed as shown in FIGS. 4 and 5, and the well and work string have been cleaned out as shown in FIG. 5, the work string 22 and the inner assembly 30 may be removed completely from the well. As the inner assembly 30 is removed, shifters close the valves 36 and 46. As the inner assembly 30 is lifted, the wash pipe 84 is removed from the screen 68 and the flapper valve 64 closes as shown in FIG. 6. If another type of fluid loss control device is used, e.g. a ball valve, a shifter may be used to close the valve. The valve 64 may be a ceramic flapper valve, or other type of fluid loss control device which may be opened or removed for production by methods known in the art. As noted above, the movements of the work string 22 have closed all three of the sleeve valves 36, 46 and 58 so that all ports in the outer assembly are closed and all produced fluids must flow through the gravel pack 92 and screen 68. In this FIG. 6 configuration, pipe 38 and screen 68 have been properly installed in an open hole well 10 with a single trip into the well. The screen 68 has been gravel packed and the blank pipe 38 has been cemented without removing and/or replacing a work string or any part of a work string. The only surface operations required are relatively small vertical repositioning, i.e. lifting and lowering the work string, and flowing of appropriate gravel packing slurry, cement and clean out fluids.

The one trip cementing and gravel packing assembly 20 of the present invention provides simple apparatus for selectively providing flow paths through a single work string for gravel packing, cementing, circulation for cleaning and, if desired, inflating packers. The flow path selection is provided by the sliding seals formed between the work string seal body 82 and the seal bores 40, 50, 54 and 62, and various combinations thereof. The selection is made simply by lifting and lowering the inner assembly 30 relative to the outer assembly 28. The movement of the inner assembly is easily performed at the surface location of the well by lifting and lowering the work string 22. Other means for selecting flow paths could be substituted if desired. For example the inner assembly could be provided with inflatable packers above and below port 78. However, this alternative would require both proper positioning of the inner assembly in the outer assembly and an additional step and/or apparatus for inflating and deflating the packers. For this and other reasons, the sliding seal arrangement shown in the figures is preferred.

With reference to the figures and the above description of the apparatus according to the present invention, it will be appreciated that in alternate embodiments, only three seal bores may be used. For example the functions of seal bores 50 and 54 may be performed with a single seal bore. The single seal bore could provide a seal above the gravel packing port 56 for the gravel packing operation and a seal below the lower cementing port 44 for the cementing operation. To do this, the length of the seal body 82 may be adjusted or the structure of the packer 52 may be modified to form part of the seal bore. The disclosed embodiment uses separate seal bores 50 and 54 to allow use of available components and reduce the need for making special purpose components.

With reference to FIG. 1, an alternative embodiment will be described. In the first embodiment, the lower cementing port 44 is used to flow cement into the annulus 48 and the upper cementing port 36 is used as a return flow path. If desired, the annulus 48 may be cemented by flowing cement out the upper port 36 into the annulus 48 and using the lower port 44 as a return path. To perform cementing from the top down, the seal bores 40 and 50 may be located above and below the port 34 instead of above and below the port 44. In addition, the check valve in port 44 may be removed. Alternatively, the check valve may be reversed to allow flow from the annulus 48 into the port 44, but may include a spring which would allow the check valve to open only at a pressure greater than the hydrostatic pressure created by the cement when annulus 48 is full of unset cement. Thus the valve would open only when cement is pumped down the work string 22 and through cross over port 78 and upper cementing port 34 with sufficient pressure to open the check valve. In any case, the check valve would prevent flow of fluid out of the lower port during cleaning of the well after cementing is completed.

In a further alternative, the lower cementing port 44 may be surrounded by or replaced with a length of screen or other filter element to act as the flow return path during cementing. A bridging particulate may be included in the cement, so that when the cement reaches the screen the particulate will plug the screen and effectively block flow of cement back into the pipe 38. This top down cementing alternative illustrates that the present invention includes one cementing port and a pair of associated seal bores, which combined with the crossover port 78 and seal body 82 allow selective positioning of the assembly to allow a cementing operation.

In the first embodiment, the packer 52 is set by pressure applied through the annulus 26. Reference to FIG. 1 shows that the packer 52 is positioned between seal bores 50 and 54. By proper selection of the spacing of seal bores 50 and 54 and the length of the seal body 82, the crossover port 78 may be positioned to selectively apply setting pressure through the work string 22 to the packer 52. By applying packer setting pressure through the work string 22, the number of elements in the well 10 which are exposed to the packer setting pressure may be reduced.

The figures illustrate a single screen assembly 66 located below the blank pipe 38. In many wells, there are multiple producing zones and it is desirable to place a screen in each zone and gravel pack each screen. In horizontal completions, it is common to have a plurality of screens positioned along the length of the horizontal portion of the well which may pass through a single producing zone. In such cases, the apparatus of the present invention may include a plurality of screen assemblies 66 each including a length of blank pipe 38 and/or 70 and a screen 68, all connected together in series. In one embodiment, each screen assembly may also include a packer 52 and gravel packing port 56 and seal bores 54 and 62 positioned relative to the packer 52 and gravel packing port 56 as illustrated in FIG. 1. As noted above, each screen assembly may also include a seal bore 50 positioned above each of the packers 52. The processes described above may then be used to selectively inflate each of the packers 52 and to sequentially gravel pack each of the screens 68. When all the screens have been gravel packed, the blank pipe 38 may then be cemented.

In another embodiment having multiple screen assemblies 66, the assemblies 66 may be connected by lengths of blank pipe 38, 70. It may be desirable to block annular flow outside the lengths of blank pipe 38, 70, by for example, cementing the annuli around such lengths of blank pipe 38, 70. Cementing of such multiple lengths of pipe between multiple screen assemblies may be accomplished by providing upper and lower cementing ports 34 and 44 and seal bores 40 and 50 for each length of pipe which is to be cemented. The inner assembly may then be positioned to selective open cementing valves and flow cement into the various annuli as described above.

While the present invention has been illustrated and described with reference to particular structures and methods of use, it is apparent that various substitutions of equivalent parts and modifications thereto may be made within the scope of the invention as covered by the appended claims.

What I claim as my invention is:

1. A well completion apparatus, comprising:

an outer assembly comprising a first cementing port and a gravel packing port positioned below the first cementing port, a first inner sealing surface positioned above the first cementing port, a second inner sealing surface positioned below the first cementing port, a third inner sealing surface positioned above the gravel packing port, and a fourth inner sealing surface positioned below the gravel packing port; and an inner assembly carried within the outer assembly comprising, a port and a seal body having a first portion extending above the port and a second portion extending below the port, the inner assembly axially movable relative to the outer assembly to positions at which (i) the seal body first portion forms a fluid seal with the third inner sealing surface and the seal body second portion forms a fluid seal with the fourth inner sealing surface, (ii) the seal body second portion forms a fluid seal with the third inner sealing surface, (iii) the seal body first portion forms a fluid seal with the first inner sealing surface and the seal body second portion forms a fluid seal with the second inner sealing surface, or (iv) the seal body second portion forms a fluid seal with the first inner sealing surface.

2. The apparatus of claim 1, wherein the second and third inner sealing surfaces comprise a single inner sealing surface.

3. The apparatus of claim 1, wherein the inner assembly is positioned so that the seal body first portion forms a fluid seal with the third inner sealing surface and the seal body second portion forms a seal with the fourth inner sealing surface and the inner assembly port is in fluid communication with the gravel packing port.

4. The apparatus of claim 1, wherein the inner assembly is positioned so that the seal body first portion forms a fluid seal with the first inner sealing surface and the seal body second portion forms a seal with the second inner sealing surface and the inner assembly port is in fluid communication with the first cementing port.

5. The apparatus of claim 1, wherein the inner assembly is positioned so that the seal body second portion forms a fluid seal with the third inner sealing surface and the inner assembly port is in fluid communication with an annulus between the outer assembly and the inner assembly.

6. The apparatus of claim 1, wherein the inner assembly is positioned so that the seal body second portion forms a fluid seal with the first inner sealing surface and the inner assembly port is in fluid communication with an annulus between the outer assembly and the inner assembly.

7. The apparatus of claim 1, further comprising a packer carried on the outer assembly above the first cementing port.

8. The apparatus of claim 1, further comprising a packer carried on the outer assembly between the first cementing port and the gravel packing port.

9. The apparatus of claim 8, wherein the inner assembly is positioned so that the seal body first portion forms a fluid seal with the second inner sealing surface and the seal body second portion forms a fluid seal with the third inner sealing surface and the inner assembly port is in fluid communication with the packer.

10. The apparatus of claim 1, wherein the outer assembly further comprises a screen positioned below the gravel packing port.

11. The apparatus of claim 10, wherein the inner assembly further comprises a wash pipe carried below the inner assembly port and positioned within the screen when the inner assembly is positioned to place the inner assembly port in fluid communication with the gravel packing port.

12. The apparatus of claim 11, wherein the outer assembly further comprises a fluid loss control device positioned above the screen, the wash pipe extends through the fluid loss control device when the wash pipe is positioned within the screen, and the fluid loss control device is adapted to close when the wash pipe is removed from the screen.

13. The apparatus of claim 1, wherein the outer assembly further comprises a second cementing port.

14. The apparatus of claim 13, wherein the second cementing port is positioned above the first cementing port.

15. The apparatus of claim 13, wherein the second cementing port is positioned below the first cementing port.

16. The apparatus of claim 1, wherein the first cementing port and the gravel packing port each comprises a valve.

17. The apparatus of claim 16, wherein the inner assembly comprises at least one shifter adapted to selectively open and close the first cementing port valve and the gravel packing port valve in response to movement of the inner assembly.

18. The apparatus of claim 1, further comprising a plurality of outer assemblies connected together in series.

19. A method for completing a well, comprising:

positioning in a well an assembly comprising an outer assembly comprising a first cementing port, a gravel packing port positioned below the first cementing port, a first inner sealing surface positioned below the gravel packing port, and a second inner sealing surface positioned above the gravel packing port and an inner assembly carried within the outer assembly, the inner assembly comprising, a port, and a seal body having a first portion extending above the inner assembly port and having a second portion extending below the inner assembly port, the seal body sized to form a seal with the seal bores;

moving the inner assembly to a first position at which the seal body second portion forms a fluid seal with the first inner sealing surface and the seal body first portion forms a fluid seal with the second inner sealing surface and the inner assembly port is in fluid communication with the gravel packing port; and performing a gravel packing operation.

20. The method of claim 19, further, wherein the outer assembly further comprises a third inner sealing surface positioned below the first cementing port and a fourth inner sealing surface positioned above the first cementing port, further comprising;

moving the inner assembly to second position at which the seal body second portion forms a fluid seal with the third inner sealing surface and the seal body first portion forms a fluid seal with the fourth inner sealing surface and the inner assembly port is in fluid communication with the lower cementing port; and performing a cementing operation.

21. The method of claim 20, further comprising moving the inner assembly to a fourth position at which the seal body second portion forms a fluid seal with the fourth inner sealing surface and the inner assembly port is in fluid communication with an annulus between the outer assembly and the inner assembly; and circulating clean fluid through the inner assembly port.

22. The method of claim 20, further comprising installing a packer below the first cementing port and above the gravel packing port between the outer assembly and a well bore.

23. The method of claim 22, further comprising moving the inner assembly to position at which the seal body second portion forms a fluid seal with the second inner sealing surface and the seal body first portion forms a fluid seal with the third inner sealing surface and the inner assembly port is in fluid communication with the packer; and setting the packer.

24. The method of claim 20, wherein each of the gravel packing port, and the first cementing port further comprise a valve and the inner assembly comprises at least one shifter for moving the valves between open and closed positions, further comprising after performing the gravel packing operation, moving the inner assembly to close the gravel packing port valve and to open the first cementing port valve.

25. The method of claim 24, further comprising, after performing the cementing operation, moving the inner assembly to close the first cementing port valve.

26. The method of claim 20, wherein the assembly comprises a plurality of outer assemblies, further comprising moving the inner assembly to each of the plurality of outer assemblies and performing a cementing process at each outer assembly.

27. The method of claim 19, wherein the outer assembly further comprises a second cementing port positioned above the first cementing port.

28. The method of claim 19, wherein the outer assembly further comprises a second cementing port positioned below the first cementing port.

29. The method of claim 19, further comprising moving the inner assembly to a third position at which the seal body second portion forms a fluid seal with the second inner sealing surface and the inner assembly port is in fluid communication with an annulus between the outer assembly and the inner assembly; and circulating clean fluid through the inner assembly port.

30. The method of claim 19, further comprising installing a packer above the first cementing port between the outer assembly and a well casing.

31. The method of claim 19, wherein the outer assembly comprises a screen located below the gravel packing port, and the inner assembly comprises a wash pipe positioned within the screen when the inner assembly is in the first position.

32. The method of claim 31, wherein the outer assembly comprises a fluid loss control device above the screen, further comprising removing the wash pipe from the screen and closing the fluid loss control device.

33. The method of claim 19, wherein the assembly comprises a plurality of outer assemblies, further comprising moving the inner assembly to each of the plurality of outer assemblies and performing a gravel packing process at each outer assembly.

* * * * *